US006122571A

United States Patent [19]

Gerstner et al.

[11] Patent Number: 6,122,571

[45] Date of Patent: Sep. 19, 2000

[54] POSITIVE-FEEDBACK GO/NO-GO COMMUNICATION SYSTEM

[75] Inventors: Jody D. Gerstner, Pasadena; Kenneth S. Gold, Bell Canyon, both of Calif.; Kevin L. Fenno, Orlando, Fla.

[73] Assignee: Walt Disney Enterprises, Inc., Burbank, Calif.

[21] Appl. No.: 09/456,082

[22] Filed: Dec. 7, 1999

[51] Int. Cl.[7] ..... G06F 7/70

[52] U.S. Cl. ..... 701/19; 701/20; 701/24; 472/137; 104/53; 104/60

[58] Field of Search ..... 701/19, 20, 22, 701/24, 26; 246/218, 219, 220, 246, 374, 415; 104/53, 60; 472/137

[56] References Cited

U.S. PATENT DOCUMENTS

| | | | |
|---|---|---|---|
| 3,361,082 | 1/1968 | Leslie | 104/151 |
| 4,005,837 | 2/1977 | Grundy | 246/182 B |
| 4,015,082 | 3/1977 | Matty et al. | 178/66 R |
| 4,556,941 | 12/1985 | Zuber | 701/70 |
| 4,742,460 | 5/1988 | Hollands | 701/19 |
| 4,854,529 | 8/1989 | Osada et al. | 246/187 B |
| 5,403,238 | 4/1995 | Baxter et al. | 472/43 |
| 5,440,489 | 8/1995 | Newman | 701/20 |
| 5,527,221 | 6/1996 | Brown et al. | 472/31 |
| 5,583,844 | 12/1996 | Wolf et al. | 701/1 |
| 5,590,603 | 1/1997 | Lund | 104/85 |
| 5,623,878 | 4/1997 | Baxter et al. | 246/187 C |
| 5,681,015 | 10/1997 | Kull | 246/187 C |
| 5,815,823 | 9/1998 | Engle | 701/19 |

*Primary Examiner*—William A. Cuchlinski, Jr.
*Assistant Examiner*—Yonel Beaulieu
*Attorney, Agent, or Firm*—Pretty, Schroeder & Poplawski, P.C.

[57] ABSTRACT

A positive-feedback go/no-go control system for an electric-vehicle ride (10) at an amusement park reliably communicates motion commands, vehicle-presence signals, and vehicle-status signals in the presence of high electrical noise and does so without the addition of expensive add-on equipment. The railway electric-vehicle ride includes an outbus (16) and an inbus (18) running along a railway (14). The positive-feedback go/no-go control system comprises a wayside control board (22) that provides a bipolar pulse-width-modulated command signal (26) to the outbus. A control circuit (24) onboard the electric vehicle receives the bipolar pulse-width-modulated command signal, amplitude modulates it at different frequencies that represent the electric vehicle's intended action, and provides the processed bipolar pulse-width-modulated command signal (30, 32) to the inbus. The wayside control board receives the processed bipolar pulse-width-modulated command signal, bandpass filters the frequency components, and compares the filtered frequency components to predetermined thresholds to detect the presence and intended action of the vehicle.

13 Claims, 3 Drawing Sheets

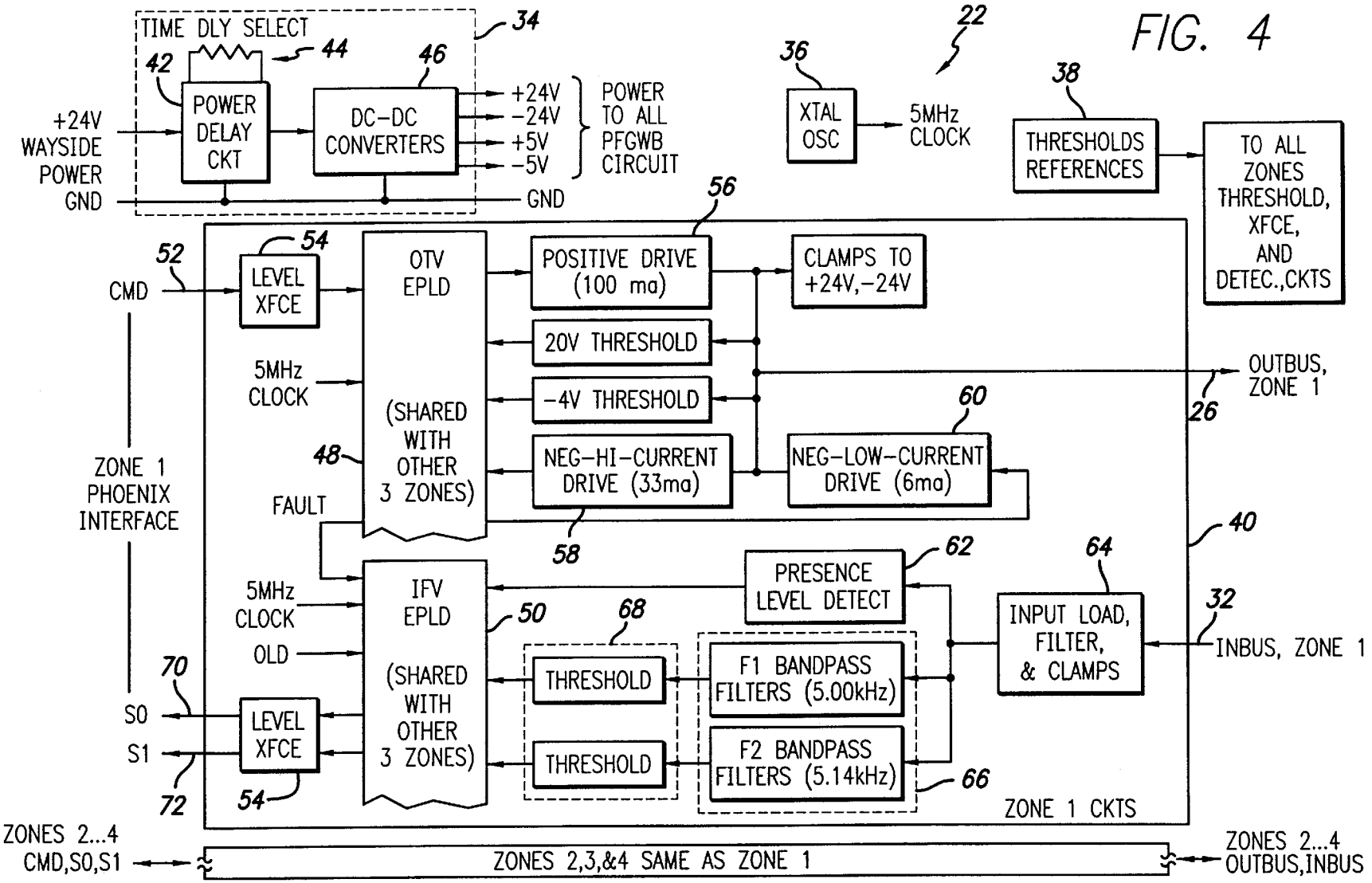
FIG. 4
TO ALL ZONES THRESHOLD, XFCE, AND DETEC.,CKTS
THRESHOLDS REFERENCES
38
22
5MHz CLOCK
XTAL OSC
36
OUTBUS, ZONE 1
26
40
INBUS, ZONE 1
32
ZONES 2...4 OUTBUS,INBUS
INPUT LOAD, FILTER, & CLAMPS
64
ZONE 1 CKTS
60
NEG-LOW-CURRENT DRIVE (6ma)
CLAMPS TO +24V,-24V
62
66
PRESENCE LEVEL DETECT
F1 BANDPASS FILTERS (5.00kHz)
F2 BANDPASS FILTERS (5.14kHz)
56
POSITIVE DRIVE (100 ma)
20V THRESHOLD
-4V THRESHOLD
NEG-HI-CURRENT DRIVE (33ma)
58
68
THRESHOLD
THRESHOLD
POWER TO ALL PFGWB CIRCUIT
+24V
-24V
+5V
-5V
GND
34
46
DC-DC CONVERTERS
OTV EPLD
(SHARED WITH OTHER 3 ZONES)
50
IFV EPLD
(SHARED WITH OTHER 3 ZONES)
ZONES 2,3,&4 SAME AS ZONE 1
44
TIME DLY SELECT
POWER DELAY CKT
42
54
LEVEL XFCE
5MHz CLOCK
48
FAULT
5MHz CLOCK
OLD
LEVEL XFCE
54
52
70
72
CMD
ZONE 1 PHOENIX INTERFACE
S0
S1
+24V WAYSIDE POWER
GND
ZONES 2...4 CMD,S0,S1

POSITIVE-FEEDBACK GO/NO-GO COMMUNICATION SYSTEM

CROSS-REFERENCES TO RELATED APPLICATIONS

Not applicable.

STATEMENT REGARDING FEDERALLY SPONSORED RESEARCH

Not applicable.

BACKGROUND OF THE INVENTION

1. Field of The Invention

The present invention relates generally to the field of railway electric-vehicle control systems, and, more particularly, to a positive-feedback go/no-go control system for a railway electric vehicle. Although the present invention is subject to a wide range of applications, it is especially suited for use in a railway electric-vehicle ride at an amusement park, and will be particularly described in that connection.

2. Description of the Related Art

A positive-feedback go/no-go control system for a railway electric vehicle provides motion commands to the electric vehicle, detects the presence of a vehicle on a section of the railway, and provides vehicle-status information.

Conventional railway electric-vehicle control systems are known. Typically, a main controller provides speed command signals to control the speed at which the vehicle is to travel. The command signals are direct-current (DC) voltages of different levels corresponding to the commanded speeds. For example, a 12-volt (V) level is a low-speed command and 24-V level is a medium-speed command.

The vehicle control system usually has two signal lines running parallel to the railway tracks upon which the electric vehicle travels. The signal lines are divided to form sections so that different command signals can be provided to different sections. The signal lines conduct the command signals to the vehicle by way of the vehicle's electrically conductive brushes that contact the signal lines.

A receiving unit on the vehicle discriminates and detects the command speed from the speed command signal. The receiving unit also has a presence-signal load circuit for generating a presence signal that is applied to the signal lines. The presence signal is generated by shunting a resistance between the signal lines, which causes a current to flow between the signal lines of the section that the vehicle is traveling over. The main controller can detect the presence signal and thus determines the presence or absence of a vehicle on a particular section.

Although suitable for some railway electric vehicles, such a control system does not provide a signal from the electric vehicle to the main controller that indicates the vehicle's intended action. Thus, in this conventional control system, the main controller cannot ascertain whether the vehicle is responding as desired or is malfunctioning.

Other schemes for the encoding the command signal are known. In a control system for a model train, the vehicle direction is controlled by the polarity of the power source, and the vehicle speed is controlled by the intensity of the power source supplying power to the train's motor.

In a known control system for a railway electric-vehicle ride at an amusement park, the encoding of the signal is pulse-width modulation. The command signal is applied to a signal line known as an outbus by a wayside controller. The presence of a 24-V signal and its pulse width indicates whether the command is "stop," "park," or "run." A 0-V command signal (no pulse) represents "stop."

The 24-V pulse passes through a vehicle-based shunt element and results in an 18-V presence signal applied to a signal line known as an inbus. The positive voltage on the inbus indicates to the wayside controller that the ride vehicle is present in a particular section or zone. If no vehicle is present in the zone, then no voltage is applied to the inbus. The lack of voltage on the inbus indicates to the wayside controller that no vehicle is present in the zone.

The wayside controller and electric vehicle also communicate by radio-frequency (r-f) signals for monitoring the ride vehicle's status. Alternatively, other forms of communication, for example, modulation of the command signal, may be utilized.

Although suitable for some railway electric vehicles, such a control system does not have the ability to detect vehicle presence when the command signal is 0 V. Further, noise is generated on the control bus bars by high-power switching, capacitive and inductive coupling with power busses that supply motive power to the electric vehicle, and brush bounce. This noise can corrupt the command signal and provide an erroneous command to the vehicle. Filtering and other techniques can resolve this situation, however, they add to the expense of the system.

Moreover, although this control system provides vehicle status information to the wayside controller, it does so with the addition of relatively expensive r-f equipment. Furthermore, if modulation of the command signal is employed to provides vehicle status information, it is subject to similar noise problems as does the command signal.

A need therefore exists for a positive-feedback go/no-go control system that reliably communicates motion commands, vehicle-presence signals, and vehicle-status signals in the presence of high electrical noise and does so without the addition of expensive add-on equipment.

BRIEF SUMMARY OF THE INVENTION

The present invention, which addresses this need, resides in a positive-feedback go/no-go control system for a railway electric-vehicle ride at an amusement park. The control system described herein provide advantages over known control systems for a railway electric-vehicle ride at an amusement park in that it reliably communicates motion commands, vehicle-presence signals, and vehicle-status signals in the presence of high electrical noise and does so with cost- effective use of electronics.

According to the present invention, a wayside control board provides a bipolar pulse-width-modulated command signal with a negative voltage value and a positive voltage value to the outbus. Thus, it is an advantageous feature of the invention that vehicle presence can be detected at all times during the command-signal cycle.

In accordance with one aspect of the present invention, the bipolar pulse-width-modulated command signal is amplitude modulated at a different frequencies that represent the electric vehicle's intended action. Thus, the intended action of the vehicle can be detected without the addition of expensive add-on equipment.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

BRIEF DESCRIPTION OF THE DRAWINGS

FIG. 4 is an electrical schematic of an embodiment of one instance of the wayside control board shown in FIG. 1.

DESCRIPTION OF THE PREFERRED EMBODIMENTS

Figure 1:
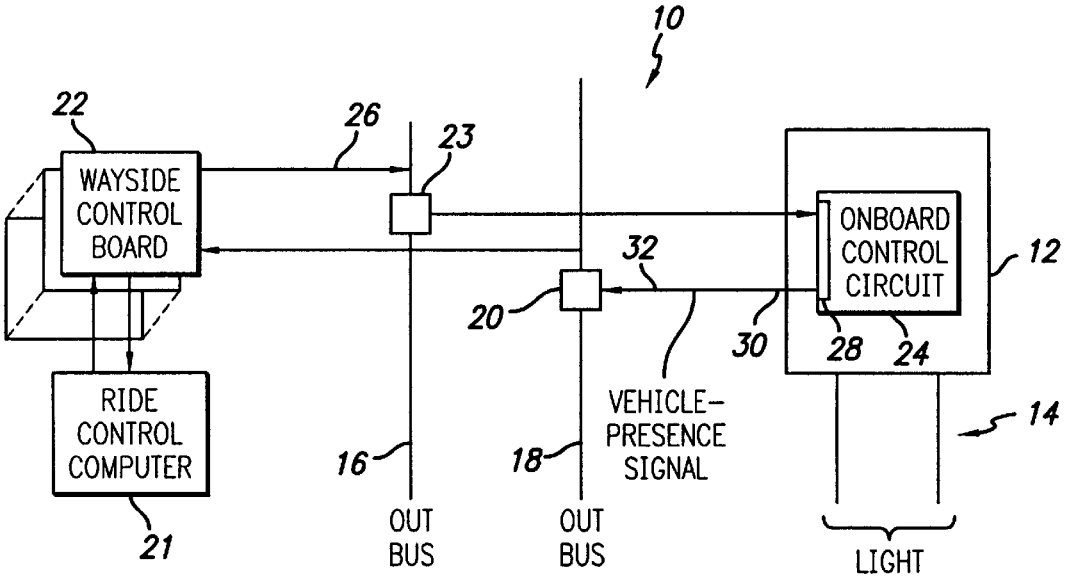
FIG. 1 is a general block diagram of a railway electric-vehicle ride at an amusement park configured according to the present invention.

As shown in the exemplary drawings, and with particular reference to FIG. 1, the present invention is embodied in a railway electric-vehicle ride at an amusement park. A railway electric-vehicle ride 10 comprises an electric vehicle 12, which travels on a light railway 14, and a pair of signal lines, which are known as the outbus 16 and the inbus 18. The signal lines run along the railway and can be divided into a plurality of zones. In the preferred embodiment, the busbar segments can be from three feet to several hundreds of feet long. Pairs of feed wires provide signals to the zone-defined busbar segments.

The electric vehicle 12 includes a pair of electrically conductive brushes 20 that pick up the signals on the signal lines. In the preferred embodiment, two electrically conductive brushes slide along each outbus 16 and each inbus 18, each brush is five inches long, and the two brushes on a given busbar are 24 inches apart and electrically connected.

The railway electric-vehicle ride 10 further comprises a positive-feedback go/no-go control system that includes a ride control computer 22, a plurality of wayside control boards 22, and a control circuit 24 onboard the electric vehicle 12. Each wayside control board 22 is in communication with the signal lines of particular zones. The vehicle control circuit is coupled to the brushes 20 via a twisted pair of wires.

The positive-feedback go/no-go control system bi-directionally communicates command signals and vehicle-status signals for command, control, and tracking of movement of electric-powered autonomous vehicles on light rails. The positive-feedback go/no-go control system reliably communicates motion commands (stop/park/run) and vehicle status information (run/stop) between the wayside control board and the electric vehicle over the outbus and the inbus in the presence of high electrical noise.

Figure 2:
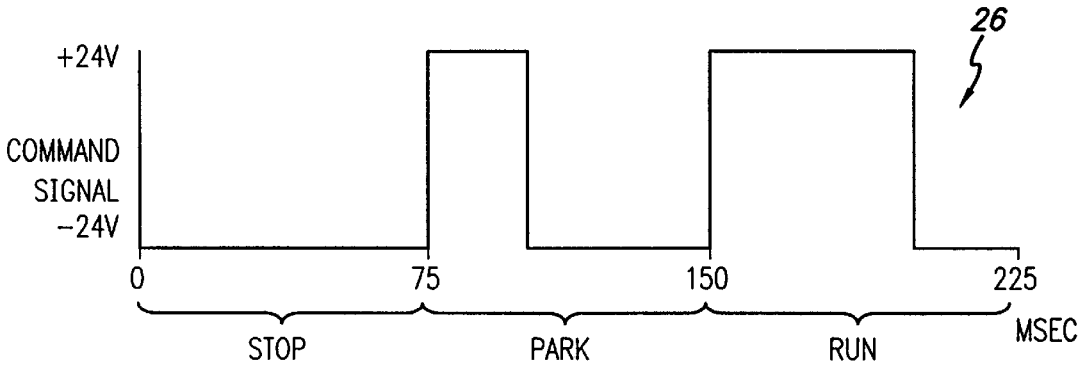
FIG. 2 is a graph illustrating an exemplary waveform of a command signal.

In this illustrated embodiment, which is configured according to the present invention, the wayside control board 22 provides a bipolar pulse-width-modulated (PWM) command signal 26 of a first frequency to the outbus 16. As shown in FIG. 2, which is a graph illustrating an exemplary waveform of the command signal, the command signal has a negative voltage value and a positive voltage value.

In this particular embodiment, the command signal 26 has a period of about 75 milliseconds (13.33 Hertz (Hz)), the negative voltage value is about −24 volts, and the positive voltage value is about +24 volts. Three periods are illustrated in FIG. 2. A continuous negative voltage value represents the command "stop," the positive voltage value for a first predetermined duration represents the command "park," and the positive voltage value for a second predetermined duration represents the command "run." In this illustrated embodiment, the first predetermined duration is about 25 millisecond, and the second predetermined duration is about 50 millisecond.

The vehicle control circuit 24 provides a dynamic non-linear shunt element 28 that is shunted from the outbus 16 to the inbus 18. The vehicle control circuit receives the bipolar pulse-width-modulated command signal 26 provided to the outbus 16 via the brush 20 sliding along the outbus. The vehicle control circuit shunts the shunt element between the outbus and the inbus to provide a vehicle-presence signal 30 to the inbus, which represents the presence of the electric vehicle in the zone that the electric vehicle is traveling along.

The wayside control board 22 receives the vehicle-presence signal 30 provided to the inbus 18 and compares the vehicle-presence signal to a pair of vehicle-presence thresholds to detect the presence of the vehicle in the zone.

Thus, when a vehicle is present in a zone, the vehicle's shunt causes the wayside- generated bipolar PWM command signal on the outbus to be connected to the inbus. In each zone, the wayside hardware on the inbus presents a finite impedance which limits the current which flows from the outbus to the inbus, and wayside sensors on the inbus detect the presence of the bipolar PWM command signal and thereby determine that a vehicle is present in the zone. Because the PWM command signal is bipolar, that is, has a negative voltage value and a positive voltage value rather than a zero level and a positive voltage value, a current will flow into (or out of) the inbus during both the negative voltage value and the positive voltage value. Hence, it is an advantageous feature of the invention that vehicle presence can be detected at all times during the command-signal cycle.

While the vehicle control circuit 24 is routing the outbus command signal 26 to the inbus 18, the vehicle control circuit measures the current flowing through the shunt to detect the command of the command signal and provides a processed command signal to an onboard vehicle control computer (not shown). The vehicle control computer responds to the command, and returns a one-bit status indicating either the vehicle is intending to move or the vehicle is intending to stop. The vehicle control circuit converts the one-bit status into a switched audio modulation by which the voltage drop across the vehicle's shunt element is modulated. Because the current that flows from the outbus to the inbus, and the voltage on the inbus, is affected by the voltage drop across the vehicle's shunt element, the amplitude modulation of the shunt generated by the vehicle can be detected as a voltage modulation into the wayside hardware on the inbus.

Figure 3:
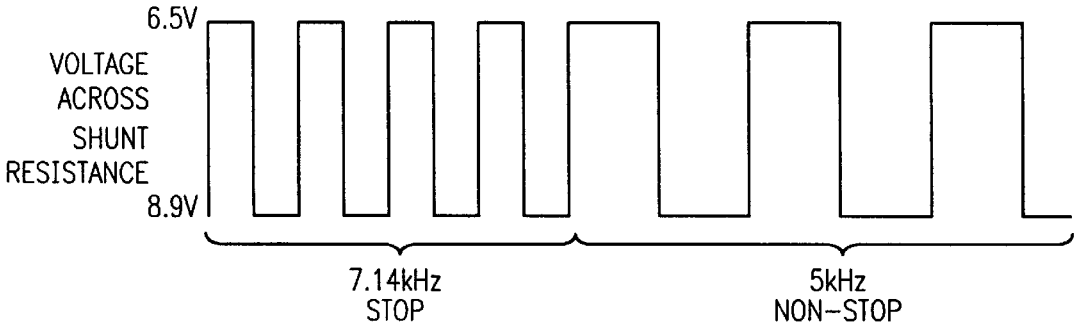
FIG. 3 is a graph illustrating an exemplary waveform of the voltage across a shunt element of an electric vehicle.

The vehicle control circuit 24 generates a vehicle-status signal 32 by amplitude modulating the received bipolar pulse-width-modulated command signal at a second frequency, which represents the electric vehicle's intended action is to "stop," and a third frequency, which represents the electric vehicle's intended action is to "not-stop." The vehicle control circuit provides the vehicle-status signal to the inbus via brush 20 sliding along inbus 18. As shown in FIG. 3, which is a graph illustrating an exemplary waveform of the voltage across the shunt element of an electric vehicle, the second frequency is about 7.14 kilohertz, which represents "stop," and the third frequency is about 5 kilohertz, which represents "not-stop," and the amplitude voltage drop is about 5.6 volts.

The wayside control board receives the vehicle-status signal 32 on inbus 18, bandpass filters the second frequency and the third frequency of the vehicle-status signal, and compares the filtered second frequency to a stop threshold and the filtered third frequency to a not-stop threshold to detect the intended action of the vehicle. Thus, the wayside sensors on the inbus detect the audio modulation and thereby have a positive indication of the vehicle's intention.

In generating the vehicle-status signal, the vehicle does not generate any signal current of its own. Instead it modulates the bipolar PWM command signal. Hence, it is an advantageous feature of the invention that vehicle status can be detected without the addition of expensive add-on equipment, such as, r-f transmitters and receivers.

FIG. 4 is an electrical schematic of an embodiment of one instance of the of the wayside control board 22 shown in FIG. 1. The wayside control board 22 includes a power supply 34, an oscillator 36, threshold voltage references 38, and a plurality of zone control circuits 40 that generate signals on the zone's outbusses 16 based upon commands from a wayside ride and monitor computer (not shown) and return status derived from signals provided to the zone control circuits on the inbusses 18.

Three 10 watt (W) DC—DC converters 46 provide a regulated set of +24, −24, +5, and −5 voltages. The power supply 34 provides the DC voltages to power the zone control circuit components. It includes a power delay circuit 42 with a time-delay select 44 (a resistor) that causes the power turnon delay to range from 15 milliseconds to 2.0 seconds. This allows the DC-to-DC converter start up on each wayside control board to be spaced in time so that the instantaneous current draw on the wayside-generated +24 V power supply is not greater than 50 amps.

The 5 megahertz crystal-controlled oscillator 36 acts as a timing reference for the components of the wayside control board.

The wayside control board 22 includes an out-to-vehicle (OTV) electronically programmable logic device (EPLD) 48 and an in-from-vehicle (IFV) EPLD 50 to implement most of the logic of the wayside control board 22. One pair of EPLDs can accommodate four zones in the preferred embodiment. The OTV EPLD 48 processes the signals to be put onto the outbus 16 and the IFV EPLD 50 processes the signals received on the inbus 18. An example of an EPLD that can be employed is part number ispLSI1032 available from Lattice Corporation.

A command signal 52 to control the motion of a vehicle in a zone is received by a DC-coupled, interface 54 and provided to the OTV EPLD 48. According to the command signal, the OTV EPLD 48 controls current limited drivers 56,58,60 to provide the bipolar PWM command signal 26 onto the outbus 16 of a zone.

The commands are driven onto the outbus as current limited signals with a nominal high level of +24 V and a nominal low level of −24 V. Because of the expectation that the brushes of a vehicle will occasionally short two zones together, a high level driven on any zones's outbus overrides the low level on an adjacent zone's outbus when the brush shorting occurs.

An input resistance 64 of each zone control circuit 40 is the major element in setting the current delivered by the outbus, through the vehicle shunt element, into the zone control circuit via the inbus. In the preferred embodiment, the input network on the inbus of the zone control circuit is resistive (1.2 kilo-ohm) below about 7 kHz. There is a zero-pole pair in the admittance with the zero at 7.24 kHz and the zero at 16 kHz. Therefore, for a relatively long command pulse, the inbus substantially appears as a resistive load. For the two fundamentals of the AC modulation generated by the vehicle control circuit 24, the inbus input impedance is slightly lower. For the harmonics of the AC modulation, the impedance decreases to under 550 ohms as frequency increases, and is always less than 700 ohms.

A presence level detect circuit 62 on the inbus of a zone detects the presence of a vehicle in the zone. The vehicle-presence threshold is set to +4 V for positive signals and −4 V for negative signals. A vehicle is considered present if the voltage is higher than the positive threshold or less than he negative threshold. The relatively low threshold was chosen to enhance vehicle detection in the unusual case when many more than two zones are shorted together, but only one is driving high.

A switched capacitor filter circuit 66 and associated threshold circuit 68 detect the presence of the two specific frequency components of the vehicle-status signal 32 to detect the intended action of the vehicle. In the illustrated embodiment, the threshold is set at 0.78 V.

The IFV EPLD 50 processes the signals from the presence level detect circuit 62 and the frequency detection circuits 66, 68 and provides two output signals 70, 72 for a given zone via level interface 54. The two signals for a given zone are identified as S0 and S1. The level indication status of the signals is as follows, where 0=0 V and 1=24 V:

| S1 | S0 | Meaning |
|---|---|---|
| 0 | 0 | An "oddball" condition. There is a zone control circuit fault or unacceptable state of the vehicle or zone. A vehicle may or may not be present in the zone. |
| 0 | 1 | There is no vehicle in the zone. |
| 1 | 0 | A vehicle is present in the zone and has reported it is not stopping. |
| 1 | 1 | A vehicle is present in the zone and has reported it is stopping. |

Thus, the presence of a vehicle and its intended action can be determined.

Figure 5:
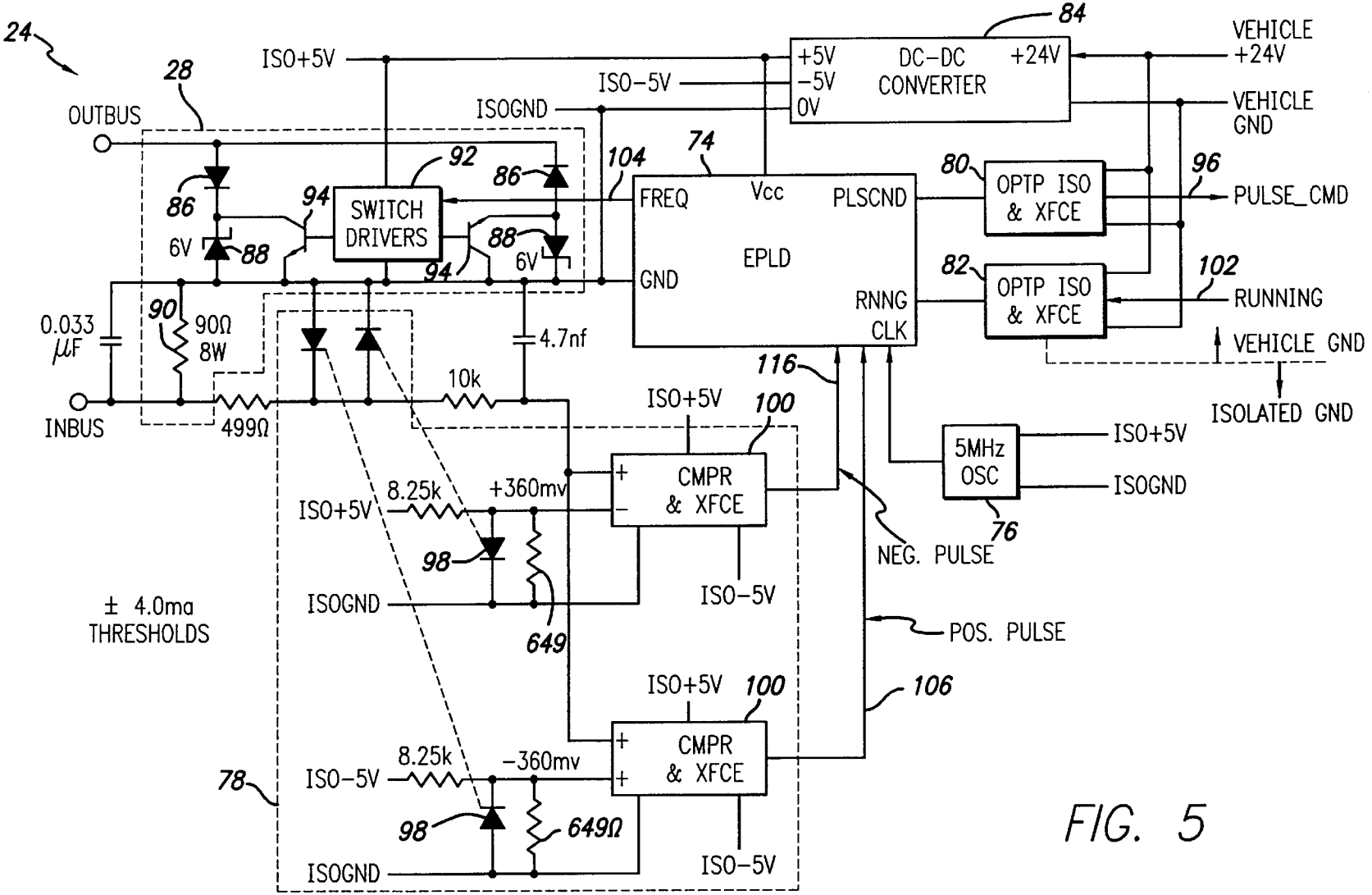
FIG. 5 is an electrical schematic of an embodiment of the control circuit onboard the electric vehicle shown in FIG. 1.

FIG. 5 is a is an electrical schematic of an embodiment of the vehicle control circuit 24 onboard the electric vehicle shown in FIG. 1. This figure illustrates, among other things, the shunt element 28, an EPLD 74 to implement most of the logic of the vehicle control circuit, an onboard 5 megahertz oscillator 76 that acts as a timing reference for the EPLD, a pulse detector 78, optical isolators 80, 82, and a 10 W DC—DC converter 84 for providing an isolated ±5 V DC voltage to the components of the vehicle control circuit from the vehicle's +24 V vehicle power.

Regardless of the direction of the current through the shunt element 28, the shunt element provides a symmetrical shunt from the zone's outbus to inbus. The shunt element normally comprises a pair of series diodes 86, a pair of zener diodes 88, a 90-ohm series resistor 90, switch drivers 92, and a pair of transistors 94.

As shown in FIG. 3, when the zener diode is unshorted, the voltage drop across the vehicle shunt element is nominally 6.5 V. When the zener diode is shorted, the voltage drop is about 0.9 V. The shorting of the zener diode causes a square wave at either 5 kHz or 7.14 kHz to be imposed on inbus 18 in the preferred embodiment. The 5 kHz rate is sent when the vehicle control computer has sent a not-stop response to the command signal; the 7.14 kHz rate is sent when the vehicle control computer has sent a stop response to the command signal.

The pulse detector 78 comprises thermally coupled diodes 98 for interfacing with the two signal busbars, and comparator interfaces 100. The pulse detector 78 measures the current through zener diodes 88 to detect the presence of positive or negative currents through the diodes. The comparator interfaces 100 provide command signals 106 derived from these currents and delivers them to the EPLD 74. An example of an EPLD that can be employed is part number ispLSI1016 available from Lattice Corporation.

The current that flows through the vehicle shunt is controlled by the external elements of the outbus driving and the inbus loading. Under normal conditions, this current can range from about 9 milliamps (ma) to 35 ma. In the preferred embodiment, a single zone control circuit input load on the inbus provides a nominal 12.6 ma through the vehicle shunt when the vehicle shunt zener is not shorted and 16.8 ma when it is shorted. The worst-case current through the vehicle shunt can be as low as 9.4 ma when the zener diode is not shorted and 13.9 ma when it is. When a vehicle's brush bridges the inbus of the next zone, there can be two zone control circuit inbus loads. The drop across the vehicle will be slightly larger, and the current through the vehicle shunt will be higher than the one zone control circuit inbus load. In the worst case condition, the shunt current can be as high as 35.9 ma.

Based on the minimum current expected, the level sensing threshold magnitude of the comparator interfaces 100 is set at 4.0 ma for both positive and negative currents. There is also time thresholding on the vehicle control circuit that requires, for every 250 microsecond ($\mu$sec) period, at least 62% of the time must be spent above the level threshold to consider the signal "above processed threshold." Further, hysteresis is added that requires that there must be a net sum of seven 250 $\mu$sec periods above the appropriate processed threshold before a vehicle command pulse 96 (PULSE_CMD) is sent to the vehicle control computer can transition from its present level (either low or high) to its new level.

Zero current through the shunt (or more specifically, not above the positive current threshold and not below the negative current threshold) requires fourteen rather than seven 250 $\mu$sec periods to cause a high to low transition. This helps to ensure that when the zone control circuit stops operating (that is, stops putting out any signal at all) for the condition when the positive pulse goes away after having been present for a few milliseconds, the vehicle command pulse 96 goes low approximately 3.6 msec after the voltage on the outbus drops to zero.

The vehicle command pulse 96 is driven to the vehicle control computer as an open collector pnp transistor drive source from +24 V, and is optically isolated from the inbus/outbus section of the vehicle control circuit by the optical isolator 80.

The vehicle control computer sends a running signal 102 to EPLD 74 via the optically isolated interface 82. The running signal indicates the vehicle's intent to stop or not-stop. The EPLD 74 converts the running signal to a modulating signal 104 that controls the switch drivers 92, which in turn causes the transistors 94 to short the zener diodes 88 at the frequency corresponding to the vehicle's intention indicated by the running signal.

The control and operation of illustrative embodiment of the positive-feedback go/no-go control system can be implemented by a computer program. In the interest of clarity, not all features of an actual implementation are described in this specification. In the development of any such actual implementation, numerous programming decisions must be made to achieve the developers' specific goals, which will vary from one implementation to another. It thus will be appreciated that such a development effort could be expected to be complex and time consuming, but would nevertheless be a routine undertaking of program development for those of ordinary skill having the benefit of this disclosure and knowledge of the functions described herein.

In conclusion, the positive-feedback go/no-go control system described herein provides reliably communicated motion commands, vehicle-presence signals, and vehicle-status signals. In the event of corrupt command signals to the vehicle, the return vehicle status signal will assure a reliable system response. This is primarily accomplished by employing a bipolar pulse-width-modulated command signal and amplitude modulating the bipolar pulse-width-modulated command signal at two different frequencies that represent the electric vehicle's intended action.

Those skilled in the art will recognize that other modifications and variations can be made in the positive-feedback go/no-go control system of the present invention and in construction and operation of this control system without departing from the scope or spirit of this invention.

What is claimed is:

1. A positive-feedback go/no-go control system for a railway electric-vehicle ride at an amusement park, the railway electric-vehicle ride including an outbus and an inbus running along the railway, the outbus and the inbus divided into a plurality of zones, the positive-feedback go/no-go control system comprising:

a wayside control board for providing a bipolar pulse-width-modulated command signal with a negative voltage value and a positive voltage value of a first frequency to the outbus; and a control circuit, onboard the electric vehicle, including a shunt element, the control circuit for, receiving the bipolar pulse-width-modulated command signal provided to the outbus, and shunting the shunt element between the outbus and the inbus to provide a vehicle-presence signal that represents the presence of the electric vehicle in the zone that the electric vehicle is traveling along to the inbus;

wherein the wayside control board, receives the vehicle-presence signal provided to the inbus, and compares the vehicle-presence signal to a vehicle-presence threshold to detect the presence of the vehicle in the zone.

2. The positive-feedback go/no-go control system of claim 1, wherein:

the negative voltage value represents the command "stop";

the positive voltage value for a first predetermined duration represents the command "park," and the positive voltage value for a second predetermined duration represents the command "run."

3. The positive-feedback go/no-go control system of claim 2, wherein the first frequency has a period of about 75 milliseconds, the negative voltage value is about −24 volts, the positive voltage value is about +24 volts, the first predetermined duration is about 25 millisecond, and the second predetermined duration is about 50 millisecond.

4. The positive-feedback go/no-go control system of claim 2, wherein:

the control circuit, amplitude modulates the received bipolar pulse-width-modulated command signal at a second frequency and a third frequency, wherein the second frequency represents the electric vehicle's intended action is to "stop" and the third frequency represents the electric vehicle's intended action is to "not-stop," to generate a vehicle-status signal, and provides the vehicle-status signal to the inbus;

the wayside control board, receives the vehicle-status signal provided to the inbus, bandpass filters the second frequency and the third frequency of the vehicle-status signal, and compares the filtered second frequency to a stop threshold and the filtered third frequency to a not-stop threshold to detect the intended action of the vehicle.

5. The positive-feedback go/no-go control system of claim 1, wherein:

the control circuit, amplitude modulates the received bipolar pulse-width-modulated command signal at a second frequency and a third frequency, wherein the second frequency represents the electric vehicle's intended action is to "stop" and the third frequency represents the electric vehicle's intended action is to "not-stop," to generate a vehicle-status signal, and provides the vehicle-status signal to the inbus;

the wayside control board, receives the vehicle-status signal provided to the inbus, bandpass filters the second frequency and the third frequency of the vehicle-status signal, and compares the filtered second frequency to a stop threshold and the filtered third frequency to a not-stop threshold to detect the intended action of the vehicle.

6. The positive-feedback go/no-go control system of claim 5, wherein the second frequency is about 7.14 kilohertz and the third frequency is about 5 kilohertz.

7. The positive-feedback go/no-go control system of claim 5, wherein the control circuit amplitude modulates the received bipolar pulse-width-modulated command signal by about 5.6 volts.

8. The positive-feedback go/no-go control system of claim 5, the control circuit further comprising:

a resistor;

a zener diode coupled in series with the resistor;

a switch, coupled in parallel with the zener diode, for shorting the zener diode at the first frequency and the second frequency to amplitude modulate the received bipolar pulse-width-modulated command signal.

9. A positive-feedback go/no-go control system for an electric-vehicle ride at an amusement park, the railway electric-vehicle ride including an outbus and an inbus running along the railway, the outbus and the inbus divided into a plurality of zones, the positive-feedback go/no-go control system comprising:

a wayside control board for providing a bipolar pulse-width-modulated command signal of a first frequency to the outbus; and a control circuit onboard an electric vehicle for, receiving the bipolar pulse-width-modulated command signal provided to the outbus, amplitude modulating the received bipolar pulse-width-modulated command signal at a second frequency and a third frequency, wherein the second frequency represents the electric vehicle's intended action is to "stop" and the third frequency represents the electric vehicle's intended action is to "not-stop," to generate a vehicle-status signal that represents an intended action of the electric vehicle, and providing the vehicle-status signal to the inbus;

wherein the wayside control board, receives the vehicle-status signal provided to the inbus, bandpass filters the second frequency and the third frequency of the vehicle-status signal, and compares the filtered second frequency to a stop threshold and the filtered third frequency to a not-stop threshold to detect the intended action of the vehicle.

10. The positive-feedback go/no-go control system of claim 9, wherein the second frequency is about 7.14 kilohertz and the third frequency is about 5 kilohertz.

11. The positive-feedback go/no-go control system of claim 9, wherein the control circuit amplitude modulates the received bipolar pulse-width-modulated command signal by about 5.6 volts.

12. The positive-feedback go/no-go control system of claim 9, the control circuit further including:

a resistor;

a zener diode coupled in series with the resistor;

a switch, coupled in parallel with the zener diode, for shorting the zener diode at the first frequency and the second frequency to amplitude modulate the received bipolar pulse-width-modulated command signal.

13. A positive-feedback go/no-go control system for a railway electric-vehicle ride at an amusement park, the railway electric-vehicle ride including an outbus and an inbus running along the railway, the outbus and the inbus divided into a plurality of zones, the positive-feedback go/no-go control system comprising:

a wayside control board for providing a bipolar pulse-width-modulated command signal of a first frequency to the outbus, wherein the bipolar pulse-width-modulated command signal has a negative voltage value and a positive voltage value, wherein the continuous negative voltage value represents the command "stop," the positive voltage value for a first predetermined duration represents the command "park," and the positive voltage value for a second predetermined duration represents the command "run"; and a control circuit onboard the electric vehicle including, a resistor;

a zener diode coupled in series with the resistor;

a switch, coupled in parallel with the zener diode, wherein the control circuit, receives the bipolar pulse-width-modulated command signal provided to the outbus, shunts the control circuit between the outbus and the inbus to provide a vehicle-presence signal that represents the presence of the electric vehicle in the zone that the electric vehicle is traveling along to the inbus, and shorts the zener diode at a first frequency and a second frequency to amplitude modulate the-received bipolar pulse-width-modulated command signal, wherein the second frequency represents the electric vehicle's intended action is to "stop" and the third frequency represents the electric vehicle's intended action is to "not-stop," to provide a vehicle-status signal representing the electric vehicle's intended action to the inbus;

wherein the wayside control board, receives the vehicle-presence signal and vehicle-status signal provided to the inbus, compares the vehicle-presence signal to a vehicle-presence threshold to detect the presence of the vehicle in the zone, bandpass filters the second frequency and the third frequency of the vehicle-status signal, and compares the filtered second frequency to a stop threshold and the filtered third frequency to a not-stop threshold to detect the intended action of the vehicle.

* * * * *